US006547246B2

(12) United States Patent
Webb

(10) Patent No.: US 6,547,246 B2
(45) **Date of Patent: *Apr. 15, 2003**

(54) METHOD AND APPARATUS FOR PLAYING ELECTIVE WAGERING CARD GAME

(75) Inventor: Derek J. Webb, Derby (GB)

(73) Assignee: Prime Table Games LLC, Las Vegas, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/467,892

(22) Filed: Dec. 21, 1999

(65) Prior Publication Data

US 2002/0074724 A1 Jun. 20, 2002

(51) Int. Cl.[7] ..... A63F 1/00
(52) U.S. Cl. ..... 273/292; 273/274; 463/12
(58) Field of Search ..... 273/292, 274; 463/12

(56) References Cited

U.S. PATENT DOCUMENTS 3,998,462 A * 12/1976 Goott ..... 273/130 H
4,651,997 A * 3/1987 Wood ..... 273/274
5,288,081 A * 2/1994 Breeding ..... 273/292
5,713,573 A * 2/1998 Nazaryan ..... 273/292
5,772,211 A * 6/1998 Nazaryan et al. ..... 273/292
5,845,906 A * 12/1998 Wirth ..... 273/274
5,845,907 A * 12/1998 Wells ..... 273/292
5,928,081 A * 7/1999 Bochichio et al. ..... 463/13
6,019,374 A * 2/2000 Breeding ..... 273/292
6,065,752 A * 5/2000 Beltran ..... 273/274
6,089,569 A * 7/2000 Trucksess ..... 273/292
6,113,101 A * 9/2000 Wirth ..... 273/274
6,126,167 A * 10/2000 Kowalczyk ..... 273/303

* cited by examiner

*Primary Examiner*—Benjamin H. Layno
*Assistant Examiner*—Dolores R. Collins
(74) *Attorney, Agent, or Firm*—Nixon & Vanderhye P.C.

(57) ABSTRACT

In a casino card game, a player makes a first elective wager and is provided with an opportunity to make a proposition wager. A dealer deals two cards, and the players can then wager whether a third card will fall between (MID) the first two cards or above (HI) or below (LOW) at least one of the first two cards. Preferably, the player betting the HI option or the LOW option will win if the third card is higher or lower, respectively, and of a same suit as at least one of the cards. The subsequent electing wager serves to direct the application of the first elective wager. With the proposition wager, the player wins if at least two of the three cards have a predetermined composite relationship based on suit and/or rank or three-card poker rankings.

29 Claims, 2 Drawing Sheets

METHOD AND APPARATUS FOR PLAYING ELECTIVE WAGERING CARD GAME

BACKGROUND OF THE INVENTION

The present invention relates to casino card games and, more particularly, to a gambling card game incorporating a novel mode of elective wagering.

There has been a dramatic diversification of product in all fields of leisure and entertainment, including the casino environment. One area that is resistant to change, however, is casino table games, where many casino staff do not want to be bothered learning new games that may not have popular appeal or may have limited longevity. Also, casino operators enjoy free use of the traditional public domain games such as Blackjack and are reluctant to pay for a new proprietary game, which would replace a royalty free use game.

The most successful new games have been derivatives of historical games, with examples being the poker variant Let it Ride, the Blackjack variant Spanish 21 and the war variant Casino War. Most new games are poker or Blackjack variants, and in due course, the market will be saturated with these products. There is thus a demand for alternative product that will have popular appeal, good potential longevity and be operationally and mathematically secure.

Red Dog is an old gambling game played under different names in different parts of the world. Each player places a wager, and then two cards are dealt. The player has an option to place a further wager and a third card is dealt. The player wins both wagers if the rank value of the third card is between the rank values of the first two cards. When the player wins, the payoffs are typically 1 to 1 except where increased odds are given relative to the difficulty of the third card falling in between the first two cards. Historically, players had a negative experience with Red Dog as the pace of the game is very fast, and Red Dog has now virtually disappeared from casino operation. A modern casino version would have to be designed to be much more equitable to the player in order to succeed.

SUMMARY OF THE INVENTION

An extension of player options would allow alternatives to wagering that the third card falls in between the first two cards. This could incorporate a compulsory second wager to show determination of the player option. Payoffs above 1 to 1 could be given for premium winning situations. Further, an additional proposition wager option on arrangements of the third card with one or more of the first two cards would allow payoffs above 1 to 1. By the innovation of more wagers and choices and generation of a lower house advantage than was previously available at Red Dog, a simple, fair game with good longevity prospects has been created.

According to the invention, a method of playing a card game includes (a) receiving at least an initial wager from a player, (b) a dealer dealing a first hand and a second hand, (c) receiving a subsequent electing wager from the player that a third hand will have a selected predetermined relationship of a plurality of possible predetermined relationships with the first hand and the second hand, (d) the dealer dealing the third hand, and (e) resolving wagers according to game rules. Each of the hands preferably consists of one card. Step (a) may be practiced by receiving a first wager from the player that is an elective wager and receiving a second wager from the player that is a proposition wager that at least two of the first card, second card and third card will have a composite predetermined relationship. The composite predetermined relationship preferably includes matching at least one of suit and rank. A scale of merit in ascending order for the composite predetermined relationship is preferably:

two cards in the same rank, three cards in the same suit, two cards in the same rank and suit three cards in the same rank, and three cards in the same rank and suit.

Step (e) may be practiced by increasing a payout for the proposition wager with increasing merit. In one operating mode, the third card is required to be one of the at least two of the first card, second card and third card.

The composite predetermined relationship may include three-card poker rankings, and step (e) may be practiced by varying a payout for the proposition wager based on a poker rank of the composite predetermined relationship. Step (a) may be further practiced by limiting the second wager to a predetermined multiple of the first wager, such as 1. The elective wager and the proposition wager may both be compulsory, or either wager may be compulsory, or only the elective wager may be compulsory while the proposition wager is optional.

Step (c) is preferably practiced by designating the subsequent electing wager for (c1) MID that the third card will be between the rankings of the first and the second cards, (c2) HI that the third card will be of a higher rank than at least one of the first and second cards, or (c3) LOW that the third card will be of a lower rank than at least one of the first and second cards. The designations of (c2) HI and (c3) LOW may require that the third card will also be of a same suit as the at least one of the first and second cards. Step (e) may be practiced by paying 1 to 1 for the initial wager and the subsequent electing wager if the third card has the relationship corresponding to the designated subsequent electing wager according to (c1), (c2) or (c3) wagered by the player. Payouts higher than 1 to 1 may be paid if the third card has an alternative relationship, such as same suit or same rank, with at least one of the first and second cards. Alternatively, wagers may be pushed if the third card has the alternative relationship.

In one mode of operation, step (d) is practiced by dealing a third card to each player, and in an alternative mode, step (d) is practiced by dealing a single third card that is shared by each player.

In accordance with another aspect of the invention, an apparatus is configured for playing a card game including a display, a player interface for receiving player input, and a processor configured to effect game play, wherein the processor enables the method according to the invention.

In accordance with yet another aspect of the invention, a casino card game includes at least one deck of playing cards, and a casino table that includes at least one playing area for a corresponding at least one player and a dealer area. The playing area has an initial wagering area for an initial wager and a subsequent wagering area for a subsequent electing wager. The dealer area includes a first hand area for a dealt first hand and a second hand area for a dealt second hand. One of the playing area and the dealer area also includes a third hand area for a dealt third hand. The hands preferably consist of one card. The initial wagering area preferably includes a first wager area for an elective wager and a second wager area for a proposition wager. The casino table may further include a rules area setting forth game rules and a payout area setting forth payout information.

In accordance with still another aspect of the invention, a method of playing a card game includes the steps of (a) receiving an initial wager from a player; (b) a dealer effecting a first stage of play according to game rules; (c) receiving a subsequent electing wager from the player that a second stage of play will have a selected predetermined relationship with the first stage of play, the subsequent electing wager directing a result of the initial wager; (d) the dealer effecting the second stage of play; and (e) resolving wagers according to game rules.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
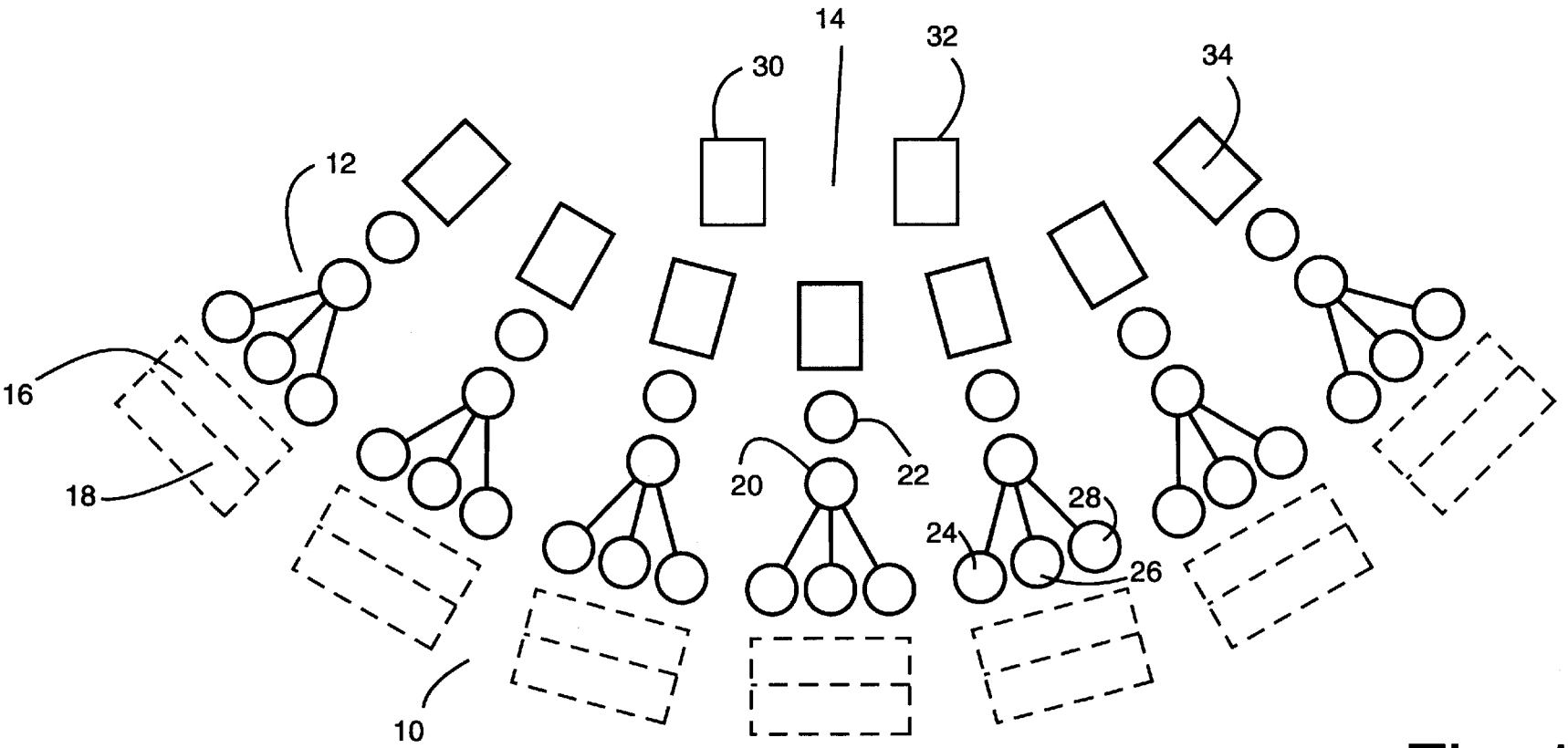
FIG. 1 is a plan view of the table layout according to the present invention.

FIG. 1 shows a casino table 10 including playing or betting areas 12 for a plurality of players, for example, seven players. The table 10 also includes a dealer area 14, a payout area 16 setting forth payout information, and a rules area 18 setting forth game rules.

The playing area 12 includes an initial wagering area 20, 22 for an initial wager and a subsequent wagering area 24, 26, 28 for a subsequent "electing" wager. The initial wagering area is divided into a first wager area 20 for an elective wager and a second wager area 22 for a proposition wager. The subsequent electing wagering areas 24, 26 and 28 are respectively for HI, MID and LOW option wagers.

The dealer area 14 includes a first card area 30 for a dealt first card or hand and a second card area 32 for a dealt second card or hand. A third card area 34 may form part of the dealer area 14 in one operating mode of the invention, while the third card area 34 forms part of each playing area 12 in another operating mode of the invention.

At least one 52-card deck of standard playing cards is used with the game according to the invention. Multiple decks, such as two to eight decks of playing cards may be used, with eight decks being a preferred embodiment. Customized or otherwise non-standard decks of playing cards may also be used with corresponding adjustments to game rules and payouts as necessary, and the invention is not meant to be limited to standard 52-card decks only.

To start the game, each player places a wager at the first wager area 20 to participate in an elective game mode and a wager at the second wager area 22 to participate in a proposition mode. The game may be operated whereby both wagers must be placed, either wager must be placed, or only the elective wager must be placed while the proposition wager is optional. In a preferred operating mode, each player must wager in the elective game mode at area 20 and may optionally wager in the proposition mode at area 22 up to the same amount as the competition wager in the elective mode. In the event of both wagers being compulsory, there could be a maximum bet relationship between the wagers as could be the case with the proposition wager being dependent upon the elective wager. Alternatively, the game could be operated in one mode only, most probably the elective game mode.

After the initial wagers are placed, the dealer deals two cards, one each to the first card area 30 and the second card area 32 face up. Each player then elects to place a subsequent electing wager that a third card will have a predetermined relationship with the first card and the second card. The players each designate the subsequent electing wager by placing the subsequent electing wager at area 24 HI that the third card will be of a higher rank than at least one of the first and second cards, area 26 MID that the third card will be between the rankings of the first and second cards, or area 28 LOW that the third card will be of a lower rank than at least one of the first and second cards. The amount of the subsequent electing wager is preferably a predetermined multiple of the initial elective wager amount at area 20 and is preferably equal to the initial elective wager amount.

The dealer then deals a third card at area 34 and compares the rank of the third card with the first and second cards and uses the additional card areas 36–46 to move the cards to a designated winning area, if appropriate. In an alternative operating mode, the third card may be dealt with the first and second cards but face down, After the players designate subsequent electing wagers, the third card is turned over. Player wagers are settled according to game rules in regular rotation with the subsequent electing wager selection at HI, MID or LOW determining the result of both the initial elective wager and the subsequent electing wager. That is, the subsequent electing wager directs the result of the initial elective wager.

If the third card has the relationship corresponding to the designated subsequent electing wager according to HI, MID or LOW wagered by the player, the player wins preferably 1 to 1 for each of the initial wager and the subsequent electing wager. In a preferred operating mode, the designations of HI and LOW require that the third card is also of a same suit as the at least one of the first and second cards that the third card is higher or lower than, respectively. That is, if the player has elected HI, then the player wins if the third card is of a higher rank than and in the same suit as at least one of the first two cards. If the player has elected LOW, the player wins if the third card is of a lower rank than and in the same suit as at least one of the first two cards. If the player has elected MID, the player wins if the third card is between the ranking of the first two cards.

Payouts higher than 1 to 1 may be paid in one operating mode of the invention if the third card has an alternative relationship with at least one of the first and second cards. For example, the alternative relationship could be that the third card is the same suit as both the first two cards or of the same rank and suit as one of the first two cards. Alternatively, where the third card is the same rank and suit as one of the first two cards, it could be considered a player win or a push rather than a loss, and if treated as a win, then higher odds could apply. The higher payouts may be applicable to any or all of the HI, MID and LOW wager designations. A higher payout may also be offered for the HI or LOW wager designations when the third card is required to be higher or lower than both the first two cards, respectively.

Although the invention has been described in the context of single cards being dealt for HI, MID and LOW wagering options, in a modified operating mode, hands of multiple cards may be dealt, and the subsequent electing wager could be a wager that a third hand will have a particular relationship with the first and second hands. This modified operating mode would still further enhance payout possibilities.

The proposition wager at the second wager area 22 is a wager that at least two of the first card, second card and third card will have a composite predetermined relationship. That is, in the proposition mode, the player is rewarded for the first, second and third cards combining to form a winning combination. In one mode, the composite predetermined relationship includes matching at least one of suit and rank. In ascending order, a preferred scale of merit in this context with all three cards is as follows:

two cards in the same rank, three cards in the same suit, two cards in the same rank and suit, three cards in the same rank, and three cards in the same rank and suit.

As an alternative, the composite predetermined relationship may require using the third card such that a two-card winning hand would not win unless one of the two cards is the third card. The payouts for the proposition wager preferably increase with increasing merit. The initial scale may alternatively start at, for example, three in the same suit (or two in the same suit when the third card is required), and the exact payoff scale may be varied as required in order to arrange the preferred house advantage.

In another version of the game, the composite predetermined relationship includes three-card poker rankings. In this context, the payout is varied for the proposition wager based on a poker rank of the composite predetermined relationship.

As would be apparent to those skilled in the relevant art, the invention can be embodied in a wide variety and forms of media such as, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disc, etc.) comprising a computer readable medium having controlled logic recorded therein to implement the features of the invention as described in relation to the invention embodiments. Control logic can be loaded into the memory of a computer and executed by a central processing unit (CPU) to perform the operations described herein.

Figure 2:
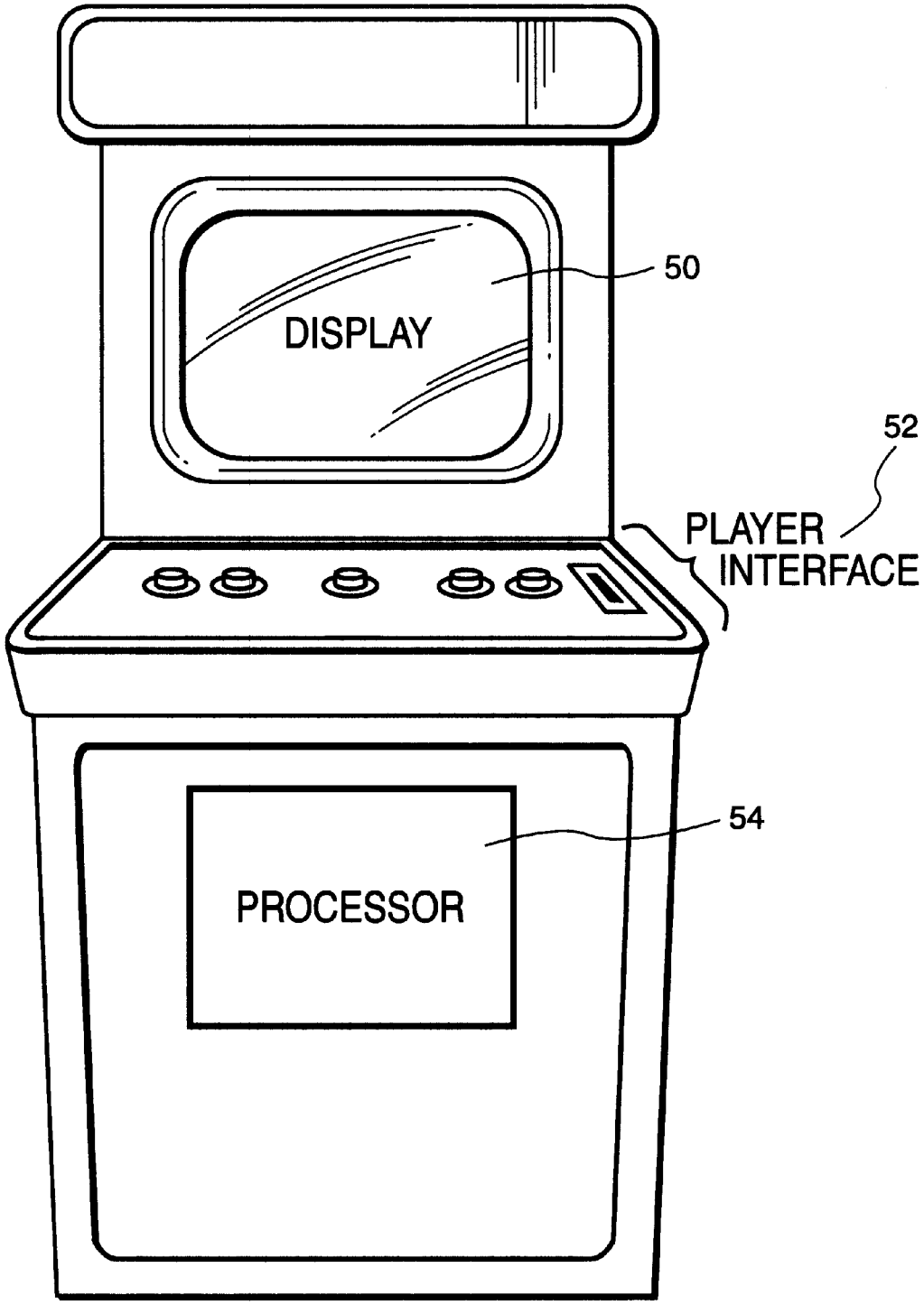
FIG. 2 is a block diagram illustrating the structure effecting game play according to the apparatus of the present invention.

In this context, referring to FIG. 2, a block diagram is illustrated showing the components of an apparatus configured for playing the game according to the invention. The apparatus includes a display 50, a player interface 52, and circuitry 54 for effecting game play and including structure for dealing cards and resolving wagers according to game rules. The initial wager, including the first elective wager and the second proposition wager, and the subsequent electing wager are received via the player interface 52, and the processing circuitry 54 effects game play according to the rules of the game and resolves wagers according to the game outcome. Those of ordinary skill in the art will contemplate various alternatives for programming a computer or the like to carry out the game according to the invention, and the invention is not meant to be limited to any particular alternative.

With the game according to the invention, the multiple wagers and operating mode choices along with the generation of a lower house advantage result in a simple and fair game with good longevity prospects. Further, alternatives to the elective wager or an additional proposition wager option on arrangements of the three cards or of the third card with one or more of the first two cards allow payoffs above 1 to 1, which further enhances player enjoyment and excitement.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a card game comprising:

(a) providing a layout including a plurality of electing wager areas;

(b) receiving at least an initial wager from a player;

(c) a dealer dealing a first hand and a second hand;

(d) receiving a subsequent electing wager from the player, determined according to a position of the electing wager on the layout, that a third hand will have a selected predetermined relationship of a plurality of possible predetermined relationships with the first hand and the second hand, wherein each of the plurality of electing wager areas on the layout corresponds to a different one of the plurality of possible predetermined relationships;

(e) determining the selected predetermined relationship based on which of the plurality of electing wager areas the player positions the electing wager on the layout, the wager areas corresponding to respective ones of the plurality of possible predetermined relationships, including (1) MID that the third hand will be between the rankings of the first and second hands, (2) HI that the third hand will be of a higher rank than at least one of the first and second hands, or (3) LOW that the third hand will be of a lower rank than at least one of the first and second hands;

(f) the dealer dealing the third hand; and (g) resolving wagers according to game rules.

2. A method according to claim 1, wherein each of the first hand, second hand and third hand consists of one card.

3. A method according to claim 2, wherein step (b) is practiced by receiving a first wager from the player that is an elective wager and receiving a second wager from the player that is a proposition wager that at least two of the first card, second card and third card will have a composite predetermined relationship.

4. A method according to claim 3, wherein the composite predetermined relationship comprises matching at least one of suit and rank.

5. A method according to claim 4, wherein a scale of merit in ascending order for the composite predetermined relationship is:

two cards in the same rank, three cards in the same suit, two cards in the same rank and suit, three cards in the same rank, and three cards in the same rank and suit.

6. A method according to claim 5, wherein step (g) is practiced by increasing a payout for the proposition wager with increasing merit.

7. A method according to claim 3, wherein the third card is required to be one of the at least two of the first card, second card and third card.

8. A method according to claim 3, wherein the composite predetermined relationship comprises three-card poker rankings.

9. A method according to claim 8, wherein step (g) is practiced by varying a payout for the proposition wager based on a poker rank of the composite predetermined relationship.

10. A method according to claim 3, wherein step (b) is further practiced by limiting the second wager to a predetermined multiple of the first wager.

11. A method according to claim 10, wherein the predetermined multiple is 1.

12. A method according to claim 3, wherein both the elective wager and the proposition wager are compulsory.

13. A method according to claim 12, wherein step (b) is further practiced by limiting the proposition wager to a predetermined multiple of the elective wager.

14. A method according to claim 13, wherein the predetermined multiple is 1.

15. A method according to claim 3, wherein only one of the elective wager and the proposition wager is compulsory.

16. A method according to claim 2, wherein step (d) is practiced by designating the subsequent electing wager for (d1) MID that the third card will be between the rankings of the first and second cards, (d2) HI that the third card will be of a higher rank than at least one of the first and second cards, or (d3) LOW that the third card will be of a lower rank than at least one of the first and second cards.

17. A method according to claim 16, wherein the designations of (d2) HI and (d3) LOW require that the third card will also be of a same suit as the at least one of the first and second cards.

18. A method according to claim 16, wherein step (g) is practiced by paying 1 to 1 for the initial wager and the subsequent electing wager if the third card has the selected predetermined relationship corresponding to the designated subsequent electing wager according to (d1), (d2) or (d3) wagered by the player.

19. A method according to claim 18, wherein step (g) is practiced by paying payouts higher than 1 to 1 if the third card has an alternative relationship with at least one of the first and second cards.

20. A method according to claim 19, wherein the alternative relationship is same suit or same rank.

21. A method according to claim 18, wherein step (g) is practiced by pushing wagers if the third card has an alternative relationship with at least one of the first and second cards.

22. A method according to claim 2, wherein step (d) is practiced by limiting the subsequent electing wager to a predetermined multiple of the initial wager.

23. A method according to claim 22, wherein the predetermined multiple is 1.

24. A method according to claim 2, wherein step (t) practiced by dealing a third card to each player.

25. A method according to claim 2, wherein step (f) practiced by dealing a single third card that is shared by each player.

26. A method according to claim 2, wherein step (f) is practiced before step (d) with the third card being dealt face down, and prior to step (f), the method comprises exposing the third card.

27. An apparatus for playing a card game, comprising:

means for providing a layout including a plurality of electing wager areas;

means for receiving at least an initial wager from a player;

means for dealing a first hand and a second hand;

means for receiving a subsequent electing wager from the player, determined according to a position of the electing wager on the layout, that a third hand will have a predetermined relationship with the first hand and the second hand, wherein each of the plurality of electing wager areas on the layout corresponds to a different one of the plurality of possible predetermined relationships;

means for determining the selected predetermined relationship based on which of the plurality of electing wager areas the player positions the electing wager on the layout, the wager areas corresponding to respective ones of the plurality of possible predetermined relationships, including (1) MID that the third hand will be between the rankings of the first and second hands, (2) HI that the third hand will be of a higher rank than at least one of the first and second hands, or (3) LOW that the third hand will be of a lower rank than at least one of the first and second hands means for dealing the third hand; and means for resolving wagers according to game rules.

28. A casino card game comprising:

at least one deck of playing cards; and a casino table that includes at least one playing area for a corresponding at least one player and a dealer area, wherein the playing area comprises an initial wagering area for an initial wager and a subsequent wagering area for a subsequent electing wager, and wherein the dealer area comprises a first hand area for a dealt first hand and a second hand area for a dealt second hand, one of the playing area and the dealer area also comprising a third hand area for a dealt third hand.

29. A method of playing a card game comprising:

providing a layout including a plurality of electing wager areas;

receiving at least an initial wager from a player;

a dealer dealing a first hand and a second hand;

receiving a subsequent electing wager from the player, determined according to a position of the electing wager on the layout, that a third hand will have a selected predetermined relationship of a plurality of possible predetermined relationships with the first hand and the second hand, wherein each of the plurality of electing wager areas on the layout corresponds to a different one of the plurality of possible predetermined relationships;

the dealer dealing the third hand; and resolving wagers according to game rules.

* * * * *